United States Patent [19]

Baker

[11] 4,168,543

[45] Sep. 25, 1979

[54] PROTECTIVE NECK GARMENT

[76] Inventor: Ronald M. Baker, 3425 E. 14th Ave., Denver, Colo. 80206

[21] Appl. No.: 827,149

[22] Filed: Aug. 24, 1977

[51] Int. Cl.[2] ..... A41D 23/00

[52] U.S. Cl. ..... 2/91

[58] Field of Search ..... 2/91, 60, 90, 100, 164, 2/142, 190, 272, 203, 207, 133, 127, 98; 132/9

[56] References Cited

U.S. PATENT DOCUMENTS

| | | | |
|---|---|---|---|
| 1,227,428 | 5/1917 | Greenberg | 2/273 |
| 1,960,312 | 5/1934 | Landorf | 2/133 |

FOREIGN PATENT DOCUMENTS

| | | | |
|---|---|---|---|
| 461487 | 6/1928 | Netherlands | 2/60 |

*Primary Examiner*—Doris L. Troutman
*Attorney, Agent, or Firm*—Howard D. Gordon

[57] ABSTRACT

A protective neck garment for wear in cold weather climate and/or during outdoor activity wherein minimal hindrance of mobility is required such as, for example, cross country skiing, downhill skiing, snowmobile racing and the like, is provided. The garment is preferably of a one piece, continuous, resiliently stretchable structure, generally tubular in shape, adapted to slip over the wearer's head and to conform closely to the wearer's neck. The garment may be slightly outwardly flared at one end thereof. In the preferred embodiment, the garment will comprise an outer, stretchable, tubular layer of a knitted wool and an inner protective layer of a cotton lining, or the like, for protection of the wearer's neck and to prevent irritation of the wearer's neck. The inner layer will preferably extend slightly beyond the edges of the outer layer to be rolled or folded thereover to protect the wearer's neck from irritation. At least one generally V-shaped slot, and preferably two substantially equally spaced generally V-shaped slots, are provided in one end of the garment. If the garment is outwardly flared at one end, the slots will be provided in the outwardly flared end.

4 Claims, 5 Drawing Figures

PROTECTIVE NECK GARMENT

BACKGROUND OF THE INVENTION

1. Field of the Invention

This invention relates to protective neck garments and in particular relates to protective neck garments of one piece, continuous substantially tubular construction.

2. Description of the Prior Art

Various protective neck garments are known in the prior art; such prior art protective garments have included scarves, mufflers, portions of sweaters and/or jackets, and the like. While these prior art protective neck garments have provided some protection, they have not been totally satisfactory as they usually involved garments which were non-continuous and thus allowed air to enter, or the garments restricted the wearer's mobility, or the garments lacked comfort and/or the garments were irritating to the wearer's neck.

SUMMARY OF THE INVENTION

In accordance with the present invention, the drawbacks of the prior art have been overcome to the extent that a protective neck garment which is relatively easy to don, is relatively inexpensive to produce, and which will provide the wearer with protection from cold weather and wind without appreciably restricting the wearer's freedom of movement, is provided. In the preferred form, a protective neck garment which is a one piece garment not requiring the wearer to wear an additional garment is provided. The above is accomplished by providing a one-piece garment in the general form of a continuous tube. The tubular body of the garment is preferably of a resilient material, such as a knitted wool or the like, to allow the garment to be stretched for pulling over the wearer's head and to then conform closely to the wearer's neck. The garment is preferably outwardly flared at one end thereof and said outwardly flared end preferably includes at least one, and preferably two, generally V-shaped slits to allow the garment to lay flat against the wearer's body. The garment may include an outer layer of an insulating material, such as knitted stretch wool or the like, and a non-irritating inner layer to protect the wearer's neck from irritation, such as of cotton or the like. The inner protective layer, if utilized, should extend slightly axially beyond the outer layer to be rolled thereover for protection of the wearer's neck.

In an alternate embodiment of the invention, a complete upper body garment, such as a sweater or the like, is provided with a collar portion having an outer layer of an insulating material, such as wool, and an inner layer of a non-irritating material, such as cotton. The inner layer extends beyond the outer layer to be rolled thereover to protect the wearer's neck from irritation.

Accordingly, it is an object of the present invention to provide a new and improved protective neck garment.

Another object of the present invention is to provide a new and improved neck garment which will have a minimal effect on the wearer's freedom of movement.

A further object of the present invention is to provide a protective neck garment in the form of a one-piece, continuous, substantially tubular body adapted to be slipped over the wearer's head and to then closely conform to the wearer's neck.

A further object of the present invention is to provide a new and improved protective neck garment comprising a substantially continuous tubular body having an outer layer of an insulating material and an inner layer to protect the wearer's neck from irritation.

These and other objects and advantages of the present invention will become apparent from a reading of the detailed description of the preferred embodiment taken in connection with the attached drawings.

DESCRIPTION OF THE PREFERRED EMBODIMENT

Figure 1:
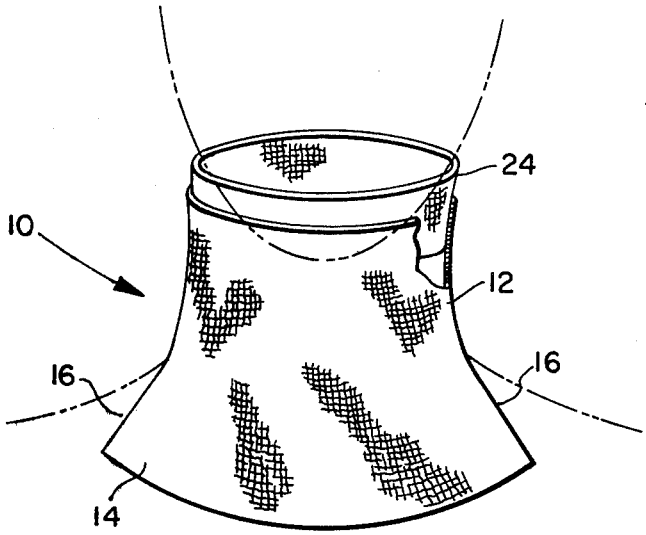
FIG. 1 is a front view of the preferred embodiment of the protective neck garment of the present invention as worn.

Certain terminology will be utilized in the following description of the preferred embodiment for convenience and reference only and will not be limiting. The terms "front", "back", "side", will refer to the garment as normally worn by a wearer. The words "right" and "left" will designate directions in the drawings to which reference is made. Said terminology will include the words above specifically mentioned, derivatives thereof, and words of similar import.

The protection neck garment 10 of the present invention as intended to be worn may be seen by reference to FIG. 1. Briefly, the garment 10 comprises a one-piece, continuous, generally tubular body 12 having an outwardly flared lower end 14 thereof. The outwardly flared lower end 14 allows the garment 10 to conform to and lie smoothly against the wearer's lower neck and to lie slightly on the wearer's shoulders to prevent air from entering under the garment. At least one, and preferably two, generally "V" shaped slots 16 are provided in the outwardly flared lower end 14 of the garment. If two slots 16 are utilized, they will be substantially diametrically opposed and designed as openings for the shoulders as may be seen in FIG. 1. Should a single slot 16 be utilized, it will preferably be placed at the rear of the garment. Slots 16 also are utilized to allow the garment 10 to lie smoothly against the neck and slightly on the shoulders to prevent air from entering under the garment.

The one-piece, substantially tubular body 12 may be knitted as an integral unit or may comprise a plurality of sections joined as at seam 18.

Figure 2:
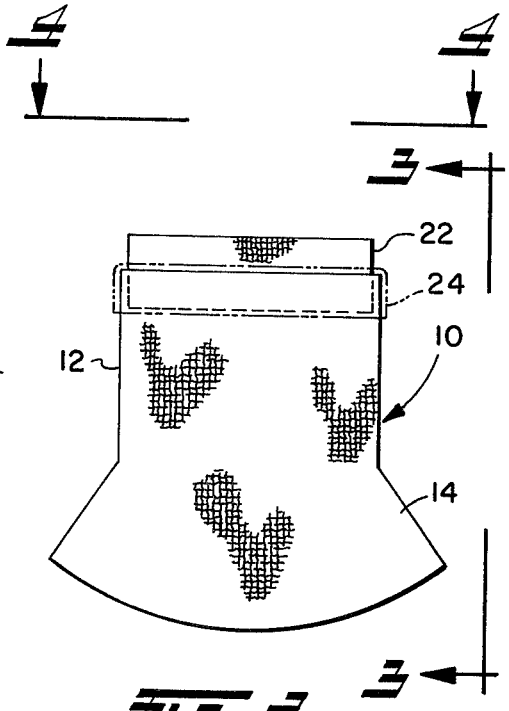
FIG. 2 is a front elevational view of the protective neck garment of the present invention.
Figure 3:
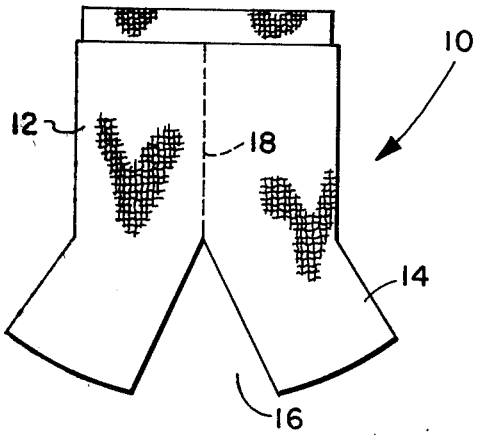
FIG. 3 is a side elevational view of the protective neck garment of the present invention.
Figure 4:
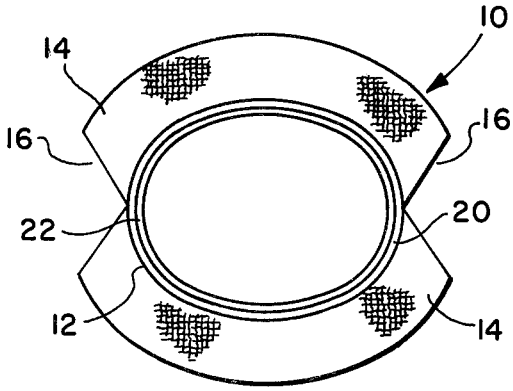
FIG. 4 is a top view of the protective neck garment of the present invention.

As may be seen, the garment may comprise an outer layer 20 and an inner layer 22. Should the outer layer 20 be of a material which is possibly irritating to the wearer's skin, such as wool or the like, the inner layer 22 will be provided to protect the wearer from irritation. Preferably, the inner layer 22 will extend slightly axially beyond the outer layer 20, such as at the upper end of the tubular body 24, allowing said axially extending portion 24 to be rolled over, or folded back on the outer layer to further protect the wearer's neck from irritation as is shown in dotted lines in FIG. 2. Of course, the inner layer may also extend slightly beyond the outer layer on the bottom of the garment.

Of course, body 12, and outer layer 20 in particular, may comprise a plurality of layers, or sublayers, of identical or differing composition.

In operation, the garment 10 is resiliently stretchable to be pulled over the wearer's head and on to position on the wearer's neck. The garment will then resiliently conform to the wearer's neck to provide warmth and protection therefor with a minimal loss of freedom of movement.

Figure 5:
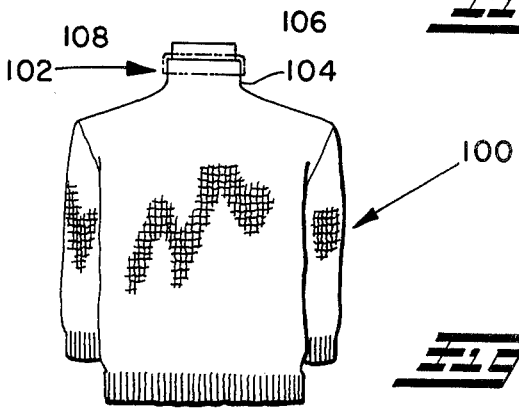
FIG. 5 is a front view of an upper body garment comprising an alternate embodiment of the present invention.

An alternate embodiment of the present invention may be seen by reference to FIG. 5. An upper body garment, such as a sweater 100, is comprised almost entirely of an insulating material such as wool or the like. The sweater 100 includes a substantially continuous, generally tubular collar 102 having an outer layer 104 composed of the material of which the sweater is made and an inner layer of 106 of a non-irritating material such as cotton or the like. The inner layer 106 includes a portion 108 extending beyond the outer layer 104 which is intended to be folded or rolled over the edge of the outer layer, as is shown in dotted lines, to protect the wearer's neck from irritation.

Although the preferred form of the present invention has been described with a certain degree of particularity, the above description is for illustrative purposes only and is not intended to be limiting. Various modifications and/or alterations of the materials and/or arrangement of the parts may be resorted to without departing from the spirit and the scope of my invention as hereinafter claimed.

I claim:

1. A protective neck garment comprising a one-piece, continuous, resiliently stretchable tubular body adapted to be pulled over the wearer's head and to conform snuggly to the wearer's neck, said tubular body having an outwardly flared end, said tubular body comprising an inner and an outer layer, said inner layer extending axially beyond said outer layer at the end thereof opposite said flared end.

2. The protective neck garment of claim 1 wherein said outwardly flared end is provided with two substantially equally circumferentially spaced slits therein.

3. The protective neck garment of claim 1 wherein said inner and outer layers are of a different material, said inner layer being of a non-irritating material.

4. The garment of claim 3 wherein said outer layer is comprised partially of wool and said inner layer is comprised partially of cotton.

* * * * *